US008403719B2

(12) United States Patent
Drennan et al.

(10) Patent No.: US 8,403,719 B2
(45) Date of Patent: Mar. 26, 2013

(54) FLOTATION VEST FOR BODY SURFING

(76) Inventors: Jeffrey Walter Drennan, Virginia Beach, VA (US); Jon Bradford Drennan, Virginia Beach, VA (US)

( * ) Notice: Subject to any disclaimer, the term of this patent is extended or adjusted under 35 U.S.C. 154(b) by 351 days.

(21) Appl. No.: 12/799,843

(22) Filed: May 4, 2010

(65) Prior Publication Data

US 2011/0086561 A1 Apr. 14, 2011

Related U.S. Application Data

(60) Provisional application No. 61/278,440, filed on Oct. 8, 2009.

(51) Int. Cl.
*B63B 35/73* (2006.01)

(52) U.S. Cl. ..... 441/65; 441/114

(58) Field of Classification Search ..... 441/65, 441/80, 88–124

See application file for complete search history.

(56) References Cited

U.S. PATENT DOCUMENTS

| | | | | |
|---|---|---|---|---|
| 785,503 | A * | 3/1905 | Krieger | 441/114 |
| 1,961,670 | A | 6/1934 | Lazar | |
| 4,689,030 | A * | 8/1987 | McWaters | 441/88 |
| 5,013,271 | A | 5/1991 | Bartlett | |
| 5,385,521 | A * | 1/1995 | Weissbuch | 482/55 |
| 6,260,199 | B1 | 7/2001 | Grunstein et al. | |
| 7,305,715 | B2 | 12/2007 | Orsos | |
| 2010/0017931 | A1 | 1/2010 | Whaley | |

* cited by examiner

*Primary Examiner* — Edwin Swinehart
(74) *Attorney, Agent, or Firm* — William G. Sykes

(57) ABSTRACT

A sleeveless, torso-encircling vest having an open front to facilitate donning the vest useful for body surfing. Closures, for example a hook-and-loop fastening system, secure the two front portions of the vest to one another after the vest is in place on a wearer's body. Flotation material is placed only in a back panel of the vest to help properly orient a wearer while body surfing. The garment is lightweight, easy to put on, and streamlined in the water when on the wearer's body. The hook-and-loop closure system provides adjustability so that a single size vest properly fits a large range of body sizes. However, the vest may be provided in different sizes such as adult and child sizes.

6 Claims, 5 Drawing Sheets

FLOTATION VEST FOR BODY SURFING

RELATED APPLICATIONS

This application claims priority to U.S. Provisional Patent Ser. No. 61/278,440 for BODY SURFING VEST, filed Oct. 8, 2009 in accordance with 37 C.F.R. §119(e) and which is included herein in its entirety by reference.

FIELD OF THE INVENTION

The invention pertains to flotation devices for wearing by a person and, more particularly, to a flotation vest for body surfers having flotation only on a back portion of the vest.

BACKGROUND OF THE INVENTION

Body surfing is one form of the sport of surf riding or surfing. Surfing may be carried out through the use of a surf board upon which the surfer crouches with the board providing the buoyancy necessary to support the surfer and functioning as a wave propelled marine craft. Alternatively, an inflatable raft capable of supporting the body of the surfer who lays face downward on the raft may be employed, with the wave again propelling the raft and its occupant in a generally horizontal fashion from the point where the wave breaks to the beach.

For years, body surfing has also been enjoyed by swimmers and the like who simply extend their bodies horizontally, project their arms forwardly and in line with their body while allowing the breaking wave to drive them shoreward with the surf until contact is made with the beach. Body surfing is a sport enjoyed by bathers whenever the waves are large enough to propel one's body with the surf. Typically, a person wades into the water until the water is approximately chest deep and then awaits a proper wave (normally a larger wave than usual). Just before the wave breaks, the body surfer springs from the bottom, lies horizontally in the water and places his arms outstretched and towards the shore. When engulfed in the force of the breaking wave, the body surfer enjoys a thrilling horizontal ride onto the beach. Where the surf is relatively large, generally caused by a seasonal storm or the like, the force exerted by the surf can be strong. It is possible for a body surfer to be forceably driven onto the beach by such surf. When this occurs, severe abrasions to the surfer's body, often about the shoulders, arms and even the face my occur. Under some circumstances, depending upon wave activity and beach or shore characteristics, the body surfer can be thrown upside down particularly where the surf tends to drive the surfer forwardly and downwardly instead of horizontally with the surf onto the beach.

Because of these possibilities, many body surfers choose to wear some form of a protective garment, typically providing at least some buoyancy to protect their bodies. In some localities, authorities may requires swimmers (i.e., body surfers) to wear some form of flotation device before being allowed to enter the water whenever surf is "up" to a point where it is potentially dangerous to the bather. Typically, bathers are not equipped with a life vest or other satisfactory flotation device that meets the requirements of the life guard. Typically such life jackets are bulky and difficult to carry to the beach along with other personal belongings often used at the beach.

However, several protective and flotation devices may be found in the prior art.

DISCUSSION OF THE RELATED ART

U.S. Pat. No. 1,961,670 for AQUATIC ACCESSORY, issued Jun. 5, 1934 to Abraham Lazar teaches a flotation device attached to a strap, the strap being adapted to encircle the torso of a wearer and support a flotation ball behind a wearer.

U.S. Pat. No. 4,397,636 for BODY SURFING SHIRT, issued Aug. 9, 1983 to Samuel H. Ganshaw discloses a pullover garment with long sleeves having elastic cuffs, collar, and waistband. Flotation pads are disposed in the forearms and chest regions of the garment.

U.S. Pat. No. 6,260,199 for SWIMWEAR WITH BUOYANT NECK SUPPORT AND BODY PANELS, issued Jul. 17, 2001 to Eugen Grunstein et al. teaches a garment featuring a front zipper closure. The garment include buoyant material in its front and back panels.

U.S. Pat. No. 7,305,715 for BATHING SUIT WITH FLOTATION SURVIVAL FEATURE, issued Dec. 11, 2007 to Henry Joseph Orsos teaches a bathing suit incorporating two inflatable bladders stored in pockets of the bathing suit. When required, the inflatable bladders my be quickly inflated to provide flotation to the bathing suit wearer. The inflatable bladders are designed to keep a swimmer's head above water.

Published United States Patent Application No. 2010/0017931 for DRAG INDUCING SWIMWEAR, published Jan. 28, 2010 upon application by Patrick Gerald Whaley provides a garment incorporating structural features to induce drag on a swimmer for training purposes.

None of the patents and published patent application, taken singly, or in any combination are seen to teach or suggest the novel flotation vest for body surfing of the present invention.

SUMMARY OF THE INVENTION

In accordance with the present invention there is provided a sleeveless, torso-encircling vest having an open front to facilitate donning the vest. Closures, for example a hook-and-loop fastening system, secure the two front portions of the vest to one another after the vest is in place on a wearer's body. Flotation material is located only in a back panel of the vest to help properly orient a wearer while body surfing. The garment is lightweight, easy to put on, and streamlined in the water when on the wearer's body. The hook-and-loop closure system provides adjustability so that a single size vest properly fits a large range of body sizes. However, the vest may be provided in different sizes such as adult and child sizes.

It is, therefore, an object of the invention to provide a body surfing vest that is lightweight and easy to put on.

It is another object of the invention to provide a body surfing vest that provides flotation in only a back panel thereof to properly orient a body surfer in the water.

It is an additional object of the invention to provide a body surfing vest that clings tightly to a body surfers body to minimize drag on the body surfer.

It is a further object of the invention to provide a body surfing vest having a partable front panel incorporating a hook-and-loop closure system to provide ease of donning and adjustability of the vest to fit numerous body sizes.

It is a still further object of the invention to provide a body surfing vest made from a material that is impervious to water and to both infrared and ultraviolet radiation.

It is yet another object of the invention to provide a body surfing vest that is easy to manufacture and relatively inexpensive.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides a body surfing vest having a split front panel secured by a hook-and-loop fastening system.

Figure 1:
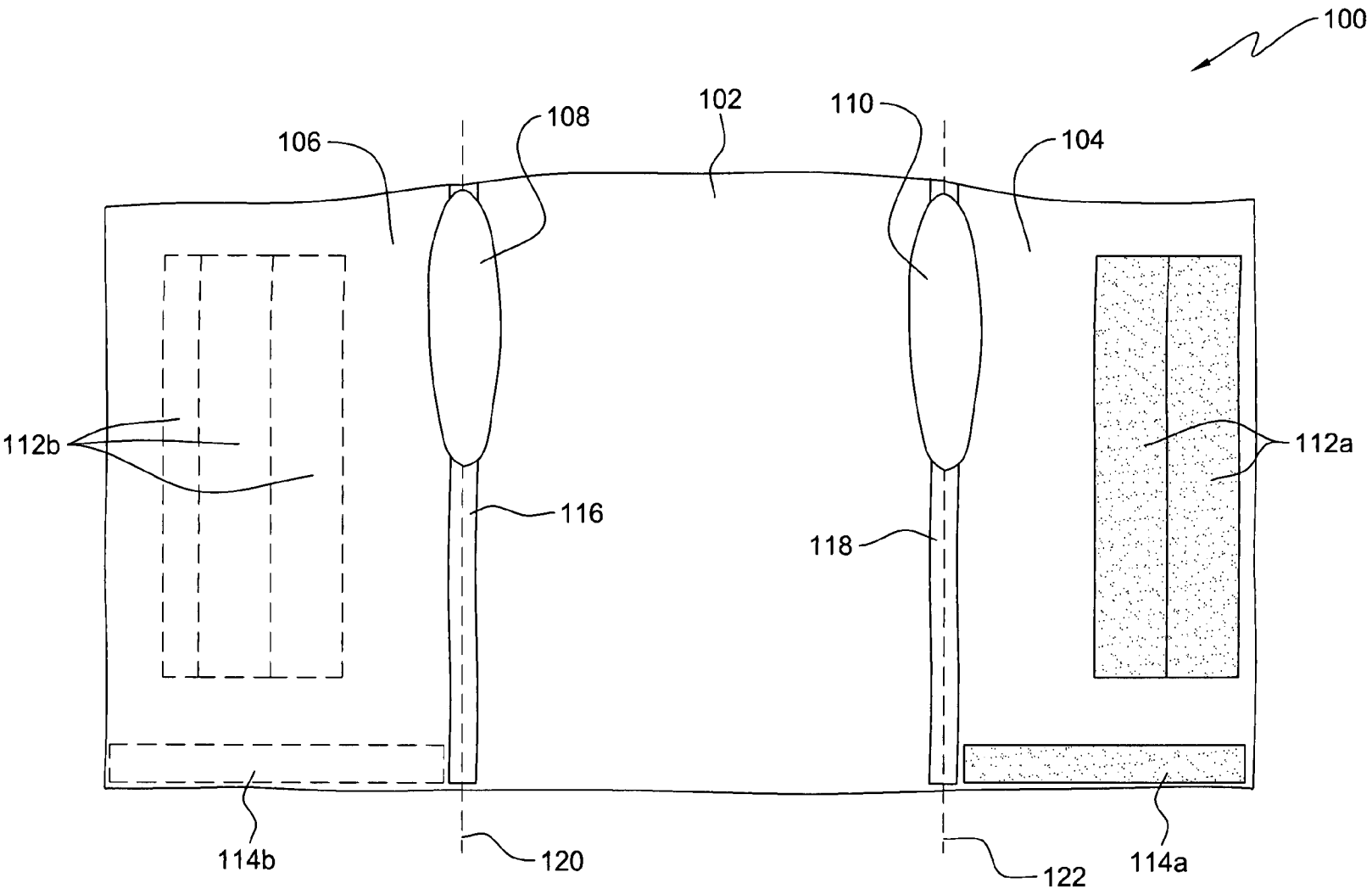
FIG. 1 is a front, elevational, schematic view of the body surfing vest of FIG. 1 having its front panels disposed in an open configuration.

Referring first to FIG. 1 there is shown a front, elevational, schematic view of the body surfing vest in accordance with the invention, generally at reference number 100. FIG. 1 shows vest 100 with both front panels completely laid open.

Vest 100 has three major sections or panels: rear panel 102, right panel 106, and left panel 104. For purposes of reference, the terms right, rear, left, top, bottom, etc. are from the perspective of a person wearing vest 100. Demarcation line 120 separates right panel 106 from back panel 102 and demarcation line 122 separates left panel 104 from back panel 102. Demarcation lines 120, 122 serve only to define regions of vest 100 for purposes of discussion.

In a preferred embodiment, right panel 106 is joined to rear panel 102 at a seam 116. Likewise, left panel 104 is joined to back panel 102 at seam 116. It will be recognized that in alternate embodiments, all panels 102, 104, 106 may be formed from single sheet of fabric, thereby possibly eliminating seams 116, 118. The invention is, therefore, not considered limited to a particular construction (e.g., discrete back, right, and left panels 102, 106, 104, respectively) joined at seams or panels 102, 104, 106 formed from a single, contiguous piece of fabric)

Right and left panels 106, 104, respectively, typically consist of a single layer of fabric. A fabric that is waterproof, quick drying, mold and mildew resistant, abrasion resistant, and UV resistant is desirable for the application. "Sport" Nylon has been found to exhibit the aforementioned characteristics and is deemed suitable for the application. A typical fabric is sport Nylon 6.6 bright available in a variety of colors from Jo-Ann Fabric & Craft Stores, 5555 Darrow Road, Hudson, Ohio 44236 USA as Catalog No. 1997162 (black). It will be recognized that many other similar fabrics from other suppliers may be substituted for the fabric chosen for purposes of disclosure.

Right panel 106 and rear panel 102 are demarked at a right arm hole 108 (seam 116 in the preferred embodiment). Likewise, left panel 104 is demarked at a left arm hole 110 (seam 118 in the preferred embodiment).

A vertical region of hook-and-loop fastening material 112*a* is disposed adjacent an outside vertical edge on an inside surface of left panel 104. Hook and loop fastening material 112*a* may be formed from multiple strips of hook-and-loop material placed parallel to one another to achieve a desired size region of hook-and-loop material 112*a*. Hook-and-loop fastening material 112*a* is typically stitched to the fabric forming left panel 104. It will be recognized that other methods,(e.g., adhesive) may possibly be used as a substitute for stitching.

Hook-and loop material 112*a* may be either a hook (i.e., male) portion or a loop (i.e., female) portion of a hook-and-loop fastening system. However, it should be noted that mating hook-and-loop material 112*b* (FIG. 2) discussed in detail hereinbelow must be of the opposite gender from that chosen for hook-and-loop material 112*a*.

A second, horizontal region of hook-and-loop fastening material 114*a* is disposed along a bottom edge of left panel 106. Like hook-and-loop material 112*a*, hook-and-loop material 114*a* may be stitched or other wise attached to the fabric forming left panel 104. As is the case with hook-and-loop fastening material 112, mating hook-and-loop material 114*b* discussed in detail hereinbelow must be of the opposite gender.

The use of hook-and-loop fastening systems 112*a*/112*b* and 114*a*/114*b* ensures that nothing protrudes from an outer surface of vest 100. This ensures both maximum streamlining while the body surfer is in the water and prevents catching the vest on an object as the body surfer reaches the shore.

Figure 2:
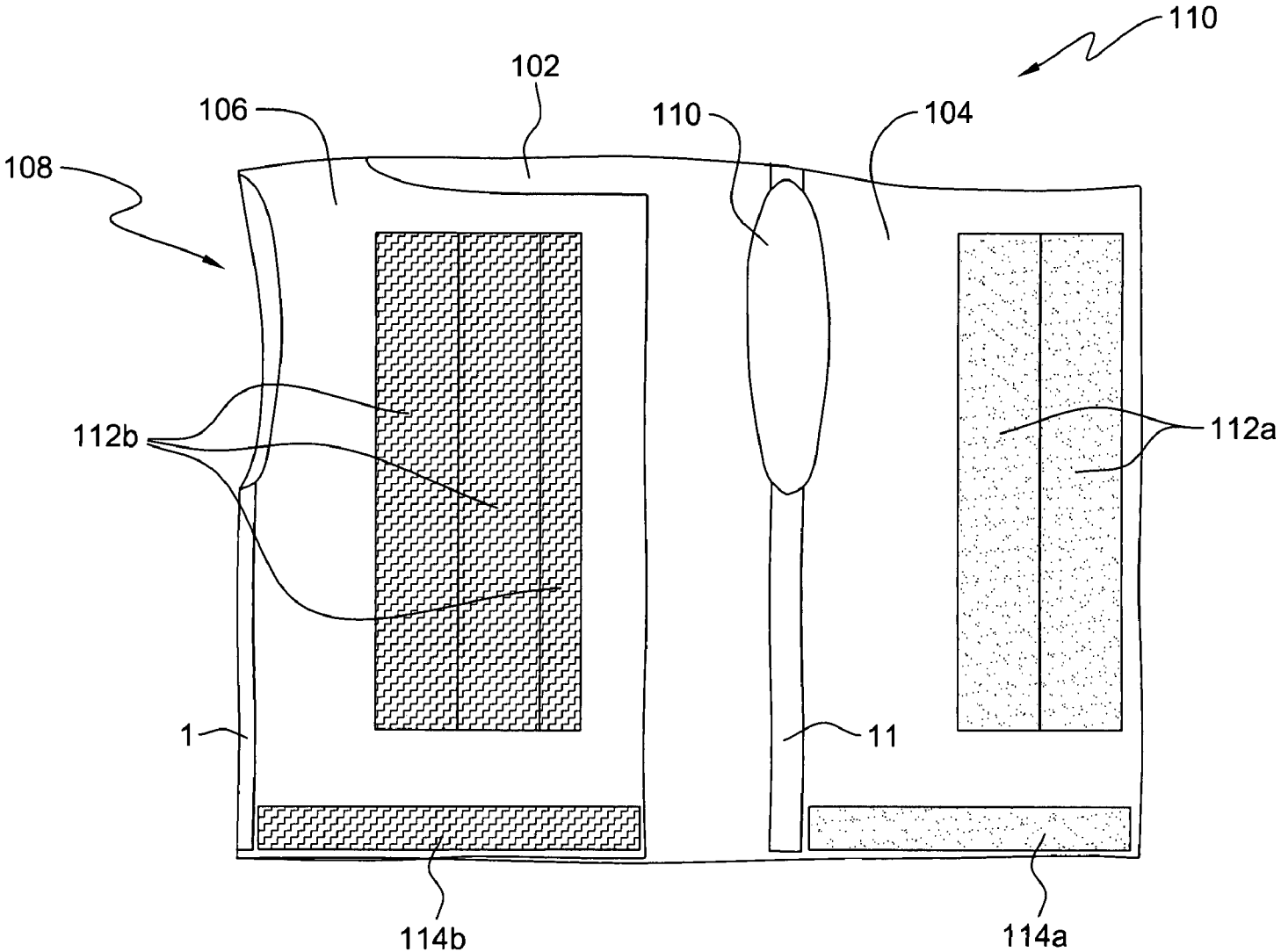
FIG. 2 is a front, elevational, schematic view of the body surfing vest of FIG. 1 having only one of its front panels disposed in an open configuration.

Referring now also to FIG. 2, there is shown a front, elevational, schematic view of the vest 100 of FIG. 1 wherein right panel 106 is folded over rear panel 102 but left panel 104 remains open. Vertical hook-and-loop fastening material 112*b* is disposed on an outer surface of right panel 106 and is adapted to interact with and removably retain hook-and-loop material 112*a*. Like hook-and-loop material 112*a*, hook-and-loop material 112*b* is typically stitched to the fabric forming right panel 106.

Horizontal hook-and-loop material 114*b* is also disposed on an outer surface of right panel 104 and is, likewise adapted to interact with and removably retain hook-and-loop material 114*a*. It will be recognized that the gender of hook-and-loop material 114*b* must be opposite the gender chosen for hook-and-loop material 114*a*.

Figure 3:
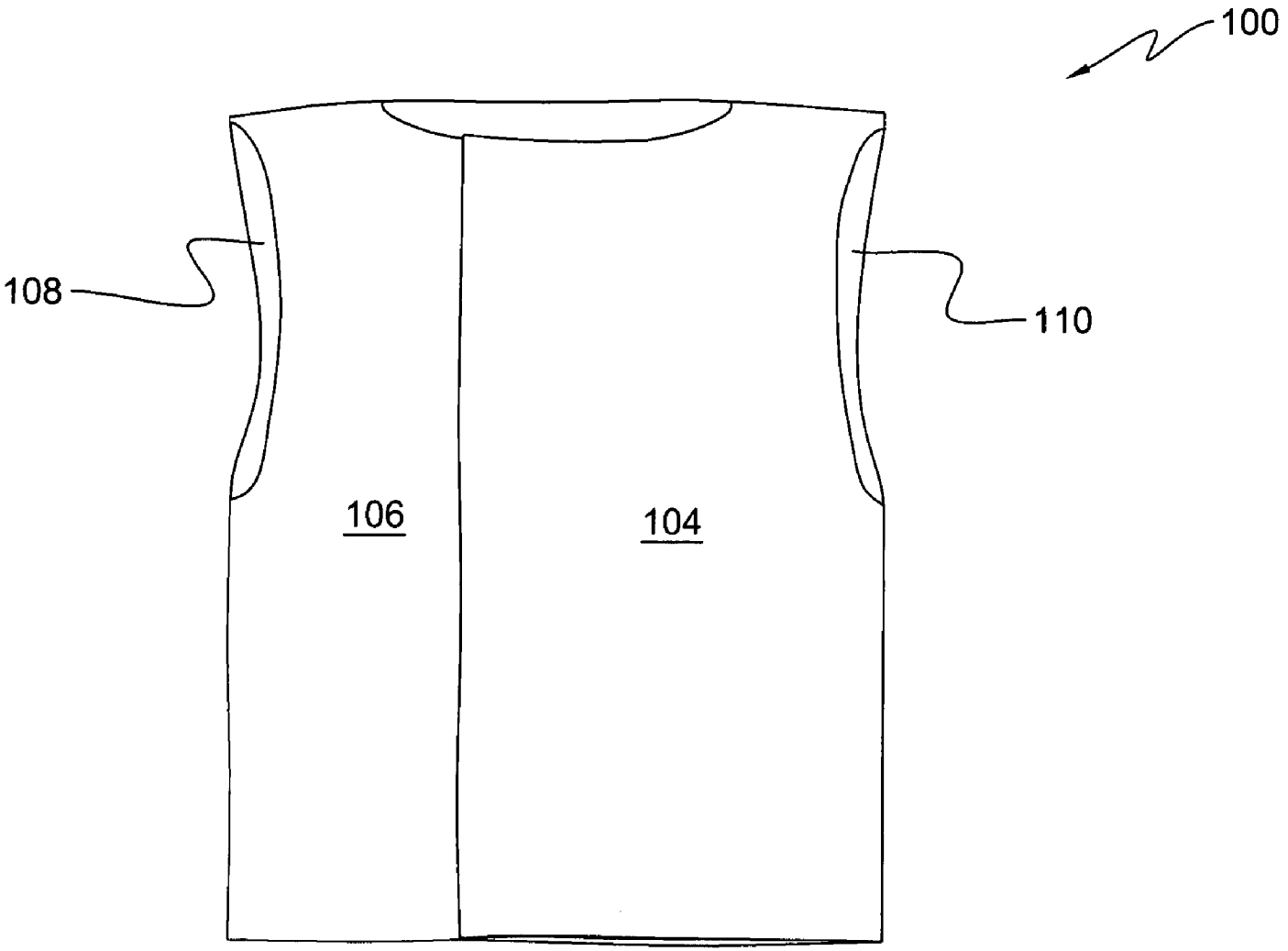
FIG. 3 is a front, elevational, schematic view of the body surfing vest of the invention with front panels in a closed, secured orientation.

Referring now also to FIG. 3, there is shown a front, elevational, schematic view of the vest 100 having both right panel 106 and left panel 104 disposed in a folded, engaged position. In the deployment of vest 100 shown in FIG. 3, hook-and-loop fastening material 112*a*/112*b* and 114*a*/114*b*, while not shown in FIG. 3, are engaged with one another, thereby securing vest 100 around the torso of a wearer, not shown.

It should be noted that the widths of vertical hook-and-loop material 112*a*/112*b* regions are relatively wide. This allows right panel 106 and left panel 104 to encircle the torsos, not shown, of wearers of a wide range of waist and/or chest measurements. Likewise, the lengths of horizontal hook-and-loop fasteners 114*a*/114*b* are both relatively long to also accommodate a wide variety of waist measurements of potential wearers of vest 100.

Figure 4:
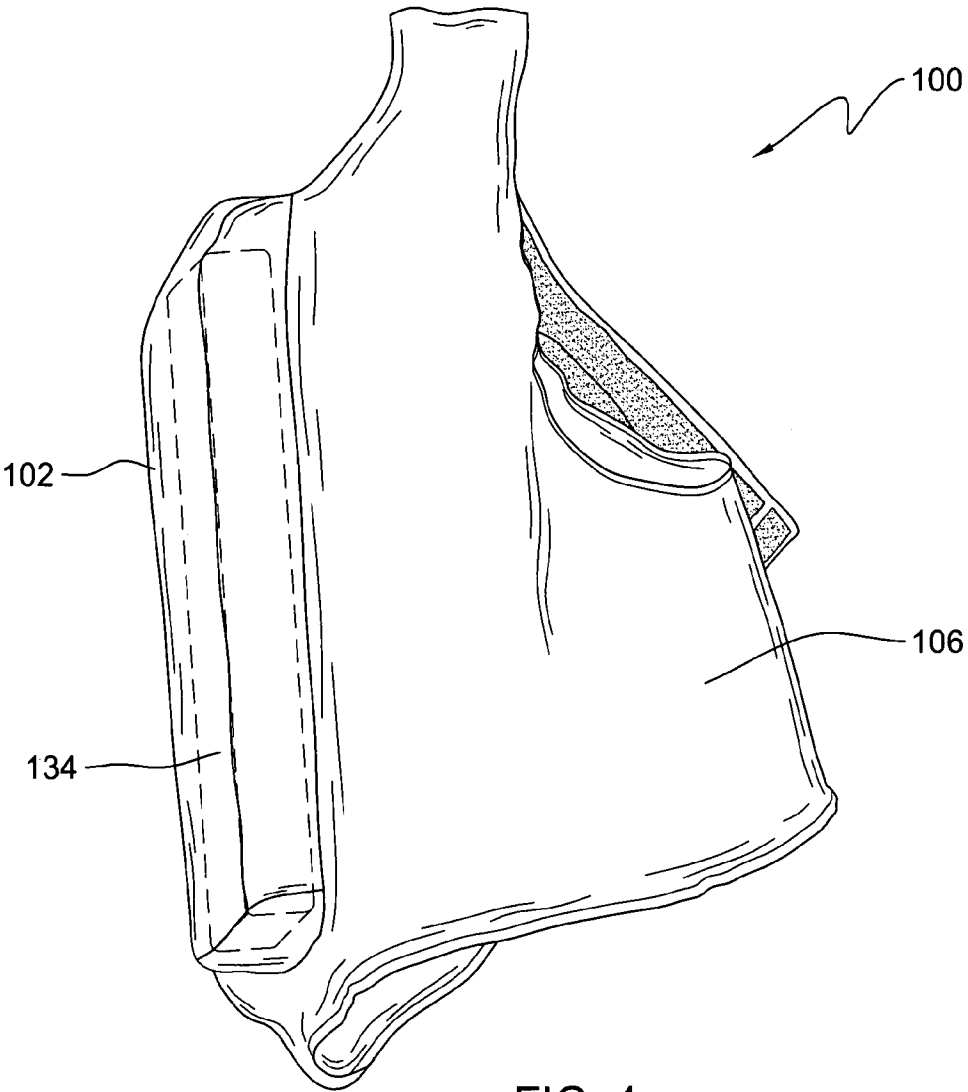
FIG. 4 is a left side, elevational, schematic view of the body surfing vest of FIG. 1.
Figure 5:
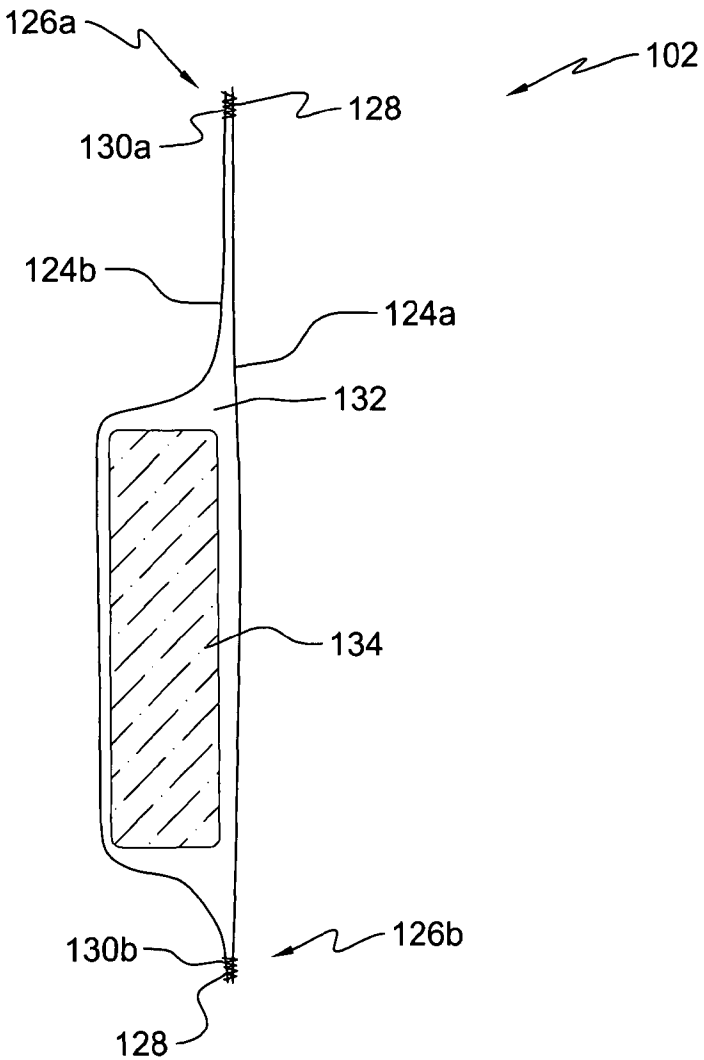
FIG. 5 is a cross-sectional view of a rear panel forming the body surfing vest of FIG. 1.

Referring now also to FIGS. 4 and 5, there are shown a side, elevational, and a side, elevational, cross-sectional schematic views, respectively, of the vest 100 in accordance with the present invention. Rear panel 102 is seen to have a relatively large thickness relative the respective thicknesses of right panel 106 and left panel 104. The thickness of rear panel 102 is caused by the presence of flotation material 134, typically hydrodynamic foam or the like. Such hydrodynamic foams are typically formed from polyethylene, polyurethane, polypropylene, arcel, or similar polymers. Such hydrodynamic foams are believed to be well known to those of skill in the art and are not further discussed herein. The specific flotation material forms no part of the present invention. Consequently, the invention includes any and all appropriate flotation materials, such materials are believed to be well known to those of skill in the art and are not further discusses herein.

FIG. 5 shows a front layer of material 124*a* joined to a rear layer of material 124*b* at upper and lower regions 126*a*, 126*b*, respectively. Stitching 128 and top and bottom seams 130*a*, 130*b* fastens inner and outer fabric layers 124*a*, 124*b* to one another forming an interior pocket, 132 that contains flotation material 134.

The placement of flotation material only in rear panel, 102 is critical to the functioning of vest 100 in its intended operating environment. Vest 100 is specifically designed for wearing by persons engaged in the sport of body surfing. Flotation material 134 disposed only in rear panel 102 enhances the body surfer's ability to swim rapidly. The novel flotation material placement also enhances the body surfer's ability to get over waves as he or she is leaving the beach by lifting the body surfer when trying to "catch" a wave.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A vest for body surfing, comprising:

a) a rear panel from the perspective of a person wearing vest having an outer vest fabric layer from the perspective of the person wearing the vest and an interior vest fabric layer from the perspective of the person wearing the vest fastened to one another at at least a top seam and a bottom seam from the perspective of a person wearing vest, said inner vest fabric layer and said outer vest fabric layer defining an interior pocket therebetween;

b) flotation material disposed only in said interior pocket;

c) a right panel from the perspective of a person wearing vest attached to a right vertical edge of said rear panel from the perspective of a person wearing vest;

d) a right arm hole disposed between said right edge of said rear panel and said right panel proximate a top edge thereof;

e) a left panel from the perspective of a person wearing vest attached to a left vertical edge of said rear panel from the perspective of the person wearing the vest; and f) a left arm hole disposed between said left edge of said rear panel and said left panel proximate a top edge thereof.

2. The vest for body surfing as recited in claim 1, further comprising:

g) hook-and-loop fastening material disposed on said outer vest fabric layer on the right panel and said inner vest fabric layer on the left panel and adapted and configured to secure said right panel to said left panel when said vest encircles the torso of a wearer.

3. The vest for body surfing as recited in claim 2, wherein said hook-and-loop material is attached to said right panel and said left panel by stitching.

4. The vest for body surfing as recited in claim 1, wherein each of said right and said left panels comprise a single layer of fabric.

5. The vest for body surfing as recited in claim 4, wherein said fabric comprises a sport Nylon fabric.

6. The vest for body surfing as recited in claim 1, wherein said flotation material comprises hydrodynamic foam.

* * * * *